US005774907A

United States Patent [19]

Doggwiler

[11] Patent Number: 5,774,907

[45] Date of Patent: Jul. 7, 1998

[54] SHOWER WALL BACK SCRUBBER AND MASSAGER

[76] Inventor: Marc Doggwiler, 63 Glover St., Sag Harbor, N.Y. 11963

[21] Appl. No.: 851,216

[22] Filed: May 5, 1997

[51] Int. Cl.[6] ..... A47K 7/02

[52] U.S. Cl. ..... 4/606; 15/104.92; 15/160; 601/136; 601/155

[58] Field of Search ..... 15/104.92, 160; 4/606; 601/136, 155

[56] References Cited

U.S. PATENT DOCUMENTS

| | | | |
|---|---|---|---|
| 3,478,369 | 11/1969 | Ensley | 4/606 |
| 3,875,604 | 4/1975 | Wurn et al. | 15/21.1 |
| 4,014,051 | 3/1977 | Pettit | 15/110 X |
| 4,020,519 | 5/1977 | Robison | 15/160 X |
| 4,040,132 | 8/1977 | Braun | 4/606 |
| 4,696,068 | 9/1987 | Kenner | 4/606 |
| 4,704,756 | 11/1987 | Williams et al. | 15/21.1 |
| 4,943,018 | 7/1990 | Glaser et al. | 15/160 X |
| 4,955,101 | 9/1990 | King | 15/21.1 |
| 5,517,705 | 5/1996 | Jackson | 15/104.92 X |
| 5,588,160 | 12/1996 | Nichols | 4/606 |

FOREIGN PATENT DOCUMENTS

| | | | |
|---|---|---|---|
| 2426432 | 12/1975 | Germany | 4/606 |
| 2613947 | 10/1977 | Germany | 15/160 |

*Primary Examiner*—Mark Spisich
*Attorney, Agent, or Firm*—Richard L. Miller, P.E.

[57] ABSTRACT

A shower wall back scrubber and massager that is replaceably attachable to a wall of a shower and fluidly connectable to a head of the shower so as to clean and massage a showerer with a back that comes in contact therewith. The massager includes a pad, attaching apparatus, fluid connecting apparatus, and cleaning and massaging apparatus. The pad is replaceably attachable to the wall of the shower and contactable by the showerer. The attaching apparatus replaceably attaches the pad to the wall of the shower so as to allow the shower wall back scrubber and massager to be replaceably attachable to the wall of the shower. The fluid connecting apparatus fluidly connects the pad to the head of the shower so as to allow the shower wall back scrubber and massager to be fluidly connectable to the head of the shower and receive water therefrom. And, the cleaning and massaging apparatus is associated with the pad and cleans and massages the showerer coming in contact with the pad and is in fluid communication with the fluid connecting apparatus so as to receive the water therefrom.

11 Claims, 1 Drawing Sheet

FIG. 1
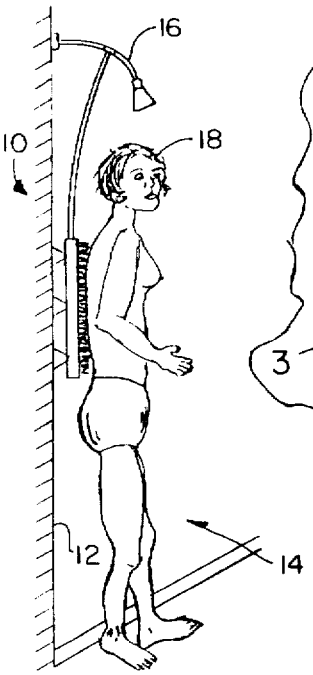
FIG. 2
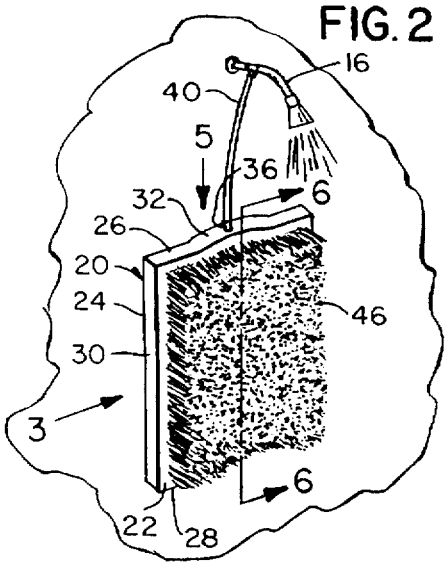
FIG. 3
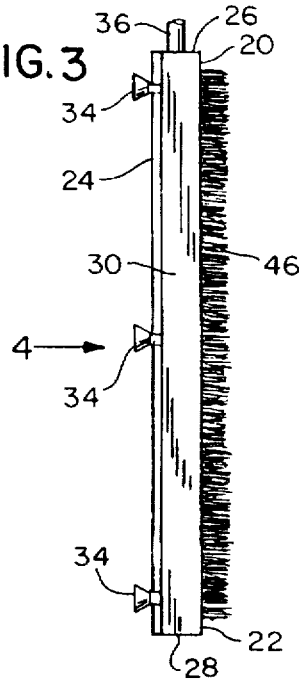
FIG. 5
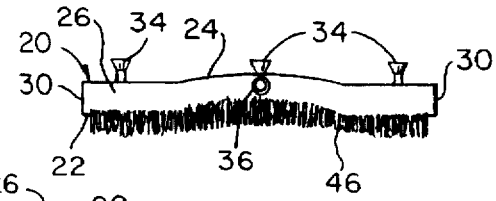
FIG. 4
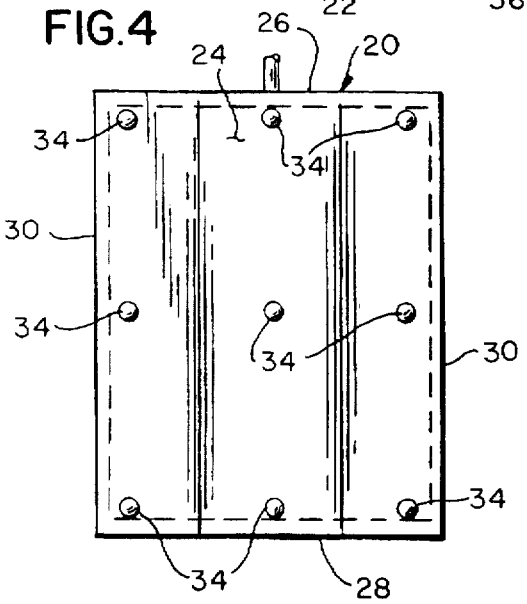
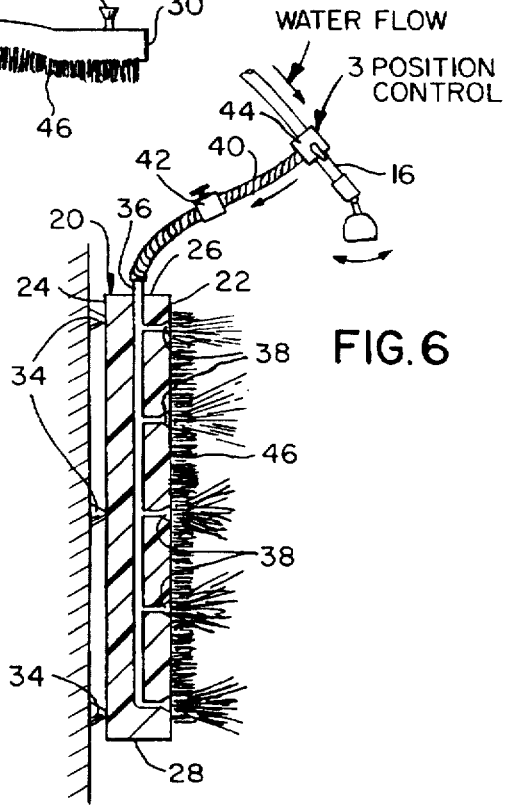
FIG. 6

SHOWER WALL BACK SCRUBBER AND MASSAGER

BACKGROUND OF THE INVENTION

1. Field of the Invention

The present invention relates to a back scrubber. More particularly, the present invention relates to a shower wall back scrubber and massager.

2. Description of the Prior Art

The prior art reveals a variety of hydraulically or motor driven brushing devices which are variously described in broad terms as brushes, scrubbers, massagers, scratchers, bathing devices, and the like. These devices include devices that are designed to be mounted on a wall, such as the wall of a shower where they are used to provide a cleansing and rejuvenating action on the body while taking a shower. The precise nature of such "action," however, may vary from one device to the next.

Numerous innovations for back scrubbers have been provided in the prior art that will be described. Even though these innovations may be suitable for the specific individual purposes to which they address, however, they differ from the present invention.

FOR EXAMPLE, U.S. Pat. No. 3,875,604 to Wurn et al. teaches a device attached to a shower wall and piped into the neck of a shower head that provides the bather with a water fed brush that rotates while it oscillates vertically. The bather then need only shift positions laterally to cover the whole back. Other features incorporated in the device are a built in soap dispenser and a means for removing the brush from the oscillating mechanism. The bather may then use the water fed rotating brush on other areas of the body.

ANOTHER EXAMPLE, U.S. Pat. No. 4,040,132 to Braun teaches a casing having a side open inwardly of a shower enclosure, and a plurality of cylindrical scrubbers rotatable in the casing and projecting out of the casing for contact with the back of a person. A transmission in a closed compartment adjacent to the casing is drivingly connected to the scrubbers. An electrical motor drive is remote from the shower enclosure. A flexible drive connects the remote motor drive to the transmission. All electrical wiring and electrically charged parts are outside of and remote from the shower enclosure.

STILL ANOTHER EXAMPLE, U.S. Pat. No. 4,696,068 to Kenner teaches a back washer and massager that is supported on a shower wall or bathtub and includes a pad of foam plastic with a waterproof cover and a rigid backing plate supported by a plurality of suction cups with a terry cloth or similar fabric cover mounted on the pad to enable easy removal for laundering and the like, with the cover for the pad including a pocket on the interior surface thereof to receive soap positioned in a net bag, so that a person taking a shower or bath can position their back or any other inaccessible area of their body against the surface of the terry cloth or other fabric cover and by moving the body area engaged with the cover provide a washing or massaging function on the surface area of the body.

YET ANOTHER EXAMPLE, U.S. Pat. No. 4,704,756 to Williams et al. teaches a shower brush apparatus that incorporates a reciprocating brush operated by a water pump operated by water diverted from the shower head supply.

FINALLY, STILL YET ANOTHER EXAMPLE, U.S. Pat. No. 14 4,955,101 to King teaches a body scrubbing brush apparatus that comprises a base support, a brush panel having a front brushing surface, and means for non-rotatably moving the brush panel in a small orbital path relative to the base support. Such movement may be achieved with an hydraulic drive mechanism. The entire apparatus may be mounted to the wall of a shower bath.

It is apparent that numerous innovations for back scrubbers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY,. AN OBJECT of the present invention is to provide a shower wall back scrubber and massager that avoids the disadvantages of the prior art.

ANOTHER OBJECT of the present invention is to provide a shower wall back scrubber and massager that is simple and inexpensive to manufacture.

STILL ANOTHER OBJECT of the present invention is to provide a shower wall back scrubber and massager that is simple to use.

BRIEFLY STATED, YET ANOTHER OBJECT of the present invention is to provide a shower wall back scrubber and massager that is replaceably attachable to a wall of a shower and fluidly connectable to a head of the shower so as to clean and massage a showerer with a back that comes in contact therewith. The massager includes a pad, attaching apparatus, fluid connecting apparatus, and cleaning and massaging apparatus. The pad is replaceably attachable to the wall of the shower and contactable by the showerer. The attaching apparatus replaceably attaches the pad to the wall of the shower so as to allow the shower wall back scrubber and massager to be replaceably attachable to the wall of the shower. The fluid connecting apparatus fluidly connects the pad to the head of the shower so as to allow the shower wall back scrubber and massager to be fluidly connectable to the head of the shower and receive water therefrom. And, the cleaning and massaging apparatus is associated with the pad and cleans and massages the showerer coming in contact with the pad and is in fluid communication with the fluid connecting apparatus so as to receive the water therefrom.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows:

FIG. 1 is a diagrammatic perspective view of the present invention installed on a typical shower wall, fluidly connected to the head of the shower, and being used utilized by a bather;

FIG. 2 is a diagrammatic perspective view of the present invention fluidly connected to the head of the shower;

FIG. 3 is an enlarged diagrammatic side elevational view taken generally in the direction of arrow 3 in FIG. 2;

FIG. 4 is a diagrammatic back elevational view taken generally in the direction of arrow 4 in FIG. 3;

FIG. 5 is an enlarged diagrammatic top plan view taken generally in the direction of arrow 5 in FIG. 2; and FIG. 6 is an enlarged cross sectional view taken on line 6—6 in FIG. 2.

LIST OF REFERENCE NUMERALS UTILIZED IN THE DRAWING

10 shower wall back scrubber and massager of the present invention
12 wall of shower 14
14 shower
16 head of shower 14
18 showerer
20 pad
22 front face of pad 20
24 back face of pad 20
26 top of pad 20
28 bottom of pad 20
30 pair of sides of pad 20
32 concave portion of pad 20
34 plurality of suction cups
36 conduit in pad 20
38 plurality of conduits in pad 20
40 hose
42 flow regulator
44 3 position diverter valve
46 bristles

DESCRIPTION OF THE PREFERRED EMBODIMENT

Referring now to the figures in which like numerals indicate like parts, and particularly to FIG. 1, the shower wall back scrubber and massager of the present invention is shown generally at 10 installed on a wall 12 of a shower 14, fluidly connected to a head 16 of the typical shower 14, and being used utilized by a showerer 18.

The configuration of the shower wall back scrubber and massager 10 can best be seen in FIG. 2–6, and as such will be discussed with reference thereto.

The shower wall back scrubber and massager 10 includes a pad 20 that is thin, rectangular-parallelepiped-shaped, flexible, vertically-oriented, made of plastic with a soft foamy texture, and completely sealed for easy cleaning.

The pad 20 has a front face 22, a back face 24 that opposes the front face 22 of the pad 20, a top 26, a bottom 28 disposed below the top 26 of the pad 20, a pair of sides 30 that are vertically-oriented and parallel and connect the top 26 of the pad 20 to the bottom 28 of the pad 20, and a concave portion 32 disposed equidistantly between, and parallel to, the pair of sides 30 of the pad 20 and extending continuously vertically from the top 26 of the pad 20 to the bottom 28 of the pad 20, and arching laterally and rearwardly from the front face 22 of the pad 20 to the back face 24 of the pad 20 so as to conform anatomically to the back of the showerer 18 so as to allow the shower 18 to position their back in the concave portion 32 of the pad 20 and by moving up and down and back and forth provide a washing and massaging function.

The pad 20 is replaceably attachable to the wall 12 of the typical shower 14 by a plurality of suction cups 34 that extend outwardly from the back 24 of the pad 20 and releasibly engage the wall 14 of the shower 14.

The pad 20 contains a conduit 36 that extends vertically centrally through the pad 20, terminates short of the bottom 28 of the pad 20, and extends slightly upwardly past the top 26 of the pad 20.

The pad 20 further contains a plurality of conduits 38 that extend forwardly from, and in fluid communication with, the conduit 36 in the pad 20, to and opening into, the front face 22 of the pad 20 so as to allow water to be discharged therefrom.

The shower wall back scrubber and massager 10 further includes a hose 40 that is flexible and fluidly connects the conduit 36 in the pad 20 to the head 16 of the shower 14 and conducts water from the head 16 of the shower 14 to the conduit 36 in the pad 20 and ultimately to, and out of, the plurality of conduits 38 in the pad 20.

The shower wall back scrubber and massager 10 further includes a flow regulator 42 that is fluidly connected in the hose 40 and selectively regulates the pressure of water conducted from the head 16 of the shower 14 to the conduit 36 in the pad 20 so as to allow the showerer 18 to select the pressure of water exiting the plurality of conduits 38 in the pad 20.

The shower wall back scrubber and massager 10 further includes a 3 position diverter valve 44 fluidly connecting the hose 40 to the head 16 of the shower 14 and selectively diverting the water to one of the head 16 of the shower 14, the hose 40, and both so as to allow the showerer 18 to select the path choice for the water.

The shower wall back scrubber and massager 10 further includes bristles 46 that extend outwardly from, and cover, the front face 22 of the pad 20 so as to increase the washing and massaging function, while either being man made or natural so as to allow for different types of skin.

It will be understood that each of the elements described above, or two or more together, may also find a useful application in other types of constructions differing from the types described above.

While the invention has been illustrated and described as embodied in a shower wall back scrubber and massager, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A shower wall back scrubber and massager replaceable attachable to a wall of a shower and fluidly connectable to a head of the shower so as to clean and massage a showerer with a back that comes in contact therewith, said massager comprising:

a) a pad replaceably attachable to the wall of the shower and contactable by the showerer;

b) attaching means for replaceably attaching said pad to the wall of the shower so as to allow said shower wall back scrubber and massager to be replaceably attachable to the wall of the shower;

c) fluid connecting means for fluidly connecting said pad to the head of the shower so as to allow said shower wall back scrubber and massager to be fluidly connectable to the head of the shower and receive water therefrom; and d) cleaning and massaging means associated with said pad for cleaning and massaging the showerer coming in contact with said pad and being in fluid communication with said fluid connecting means so as to receive the water therefrom, wherein said pad has a front face, a back face that opposes said front face of said pad, a top, a bottom disposed below said top of said pad, and a pair of sides that are vertically-oriented, parallel, and connect said top of said pad to said bottom of said pad; said pad further has a concave portion disposed equidistantly between, and parallel to, said pair of sides of said pad; said concave portion of said pad extends continuously vertically from said top of said pad to said bottom of said pad; said concave portion of said pad arches laterally-rearwardly from said front face of said pad to said back face of said pad so as to conform anatomically to the back of the showerer so as to allow the back of the showerer to be positioned in said concave portion of said pad and by the showerer moving up and down and back and forth therein provides a washing and massaging function.

2. The massager as defined in claim 1, wherein said pad is flexible plastic with a soft foamy texture and completely sealed for easy cleaning.

3. The massager as defined in claim 1, wherein said pad is thin, rectangular-parallelepiped-shaped, and vertically-oriented.

4. The massager as defined in claim 1, wherein said attaching means includes a plurality of suction cups that extend outwardly from said back face of said pad and releasibly engage the wall of the shower.

5. The massager as defined in claim 1, wherein said cleaning and massaging means includes a conduit contained in said pad that extends vertically centrally through said pad, terminates short of said bottom of said pad, and extends slightly upwardly past said top of said pad where it is fluidly connected to said fluid connecting means and receives the water therefrom.

6. The massager as defined in claim 5, wherein said cleaning and massaging means further includes a plurality of conduits contained in said pad that extend forwardly from, and in fluid communication with, said conduit in said pad, to and open into, said front face of said pad so as to allow the water from said fluid connecting means to be discharged therefrom.

7. The massager as defined in claim 6, wherein said fluid connecting means includes a hose that is flexible and fluidly connects said conduit in said pad to the head of the shower and conducts the water from the head of the shower to said conduit in said pad and ultimately to, and out of, said plurality of conduits in said pad.

8. The massager as defined in claim 7, wherein said fluid connecting means further includes a flow regulator that is fluidly connected in said hose and selectively regulates the pressure of the water conducted from the head of the shower to said conduit in said pad so as to allow the showerer to select the pressure of the water exiting said plurality of conduits in said pad.

9. The massager as defined in claim 7, wherein said fluid connecting means further includes a 3 position diverter valve that fluidly connects said hose to the head of the shower and selectively diverts the water to one of the head of the shower, the hose, and both so as to allow the showerer to select a water path.

10. The massager as defined in claim 1, wherein said cleaning and massaging means includes bristles that extend outwardly from, and cover, said front face of said pad so as to increase the washing and massaging function.

11. The massager as defined in claim 10, wherein said bristles are selected from the group consisting of man made and natural so as to allow for different types of skin.

* * * * *